US010871359B2

(12) United States Patent
Harrison

(10) Patent No.: US 10,871,359 B2
(45) Date of Patent: Dec. 22, 2020

(54) SINGLE SEAL PROJECTILE

(71) Applicant: TECHVENTURE INVESTMENTS PTY LTD, The Vines (AU)

(72) Inventor: Dale Harrison, Quinns Rocks (AU)

(73) Assignee: TECHVENTURE INVESTMENTS PTY LTD, The Vines (AU)

( * ) Notice: Subject to any disclaimer, the term of this patent is extended or adjusted under 35 U.S.C. 154(b) by 0 days.

(21) Appl. No.: 16/618,459

(22) PCT Filed: May 30, 2018

(86) PCT No.: PCT/AU2018/050527
§ 371 (c)(1),
(2) Date: Dec. 2, 2019

(87) PCT Pub. No.: WO2018/218292
PCT Pub. Date: Dec. 6, 2018

(65) Prior Publication Data

US 2020/0116463 A1 Apr. 16, 2020

(30) Foreign Application Priority Data

May 30, 2017 (AU) ..... 2017902054
Oct. 17, 2017 (AU) ..... 2017904194

(51) Int. Cl.
*F42B 14/02* (2006.01)
*F42B 10/02* (2006.01)
*F42B 10/46* (2006.01)

(52) U.S. Cl.
CPC ..... *F42B 14/02* (2013.01); *F42B 10/02* (2013.01); *F42B 10/46* (2013.01)

(58) Field of Classification Search
CPC ..... F42B 14/02; F42B 10/02; F42B 10/45; F42B 12/04; F42B 12/06; F42B 12/08; F42B 12/10

(Continued)

(56) References Cited

U.S. PATENT DOCUMENTS 165,255 A * 7/1875 Reilly ..... F42B 14/02 102/526
271,382 A * 1/1883 Vavasseur ..... F42B 14/02 102/526

(Continued)

FOREIGN PATENT DOCUMENTS

| | | |
|---|---|---|
| BE | 420793 | 3/1937 |
| WO | 2012003925 | 1/2012 |
| WO | 2013150095 | 10/2013 |

OTHER PUBLICATIONS

International Search Report for Application No. PCT/AU2018/050527 dated Jul. 27, 2018 (3 pages).

(Continued)

*Primary Examiner* — Joshua E Freeman
(74) *Attorney, Agent, or Firm* — Michael Best & Friedrich LLP

(57) ABSTRACT

A projectile (10) for firing from a barrel (12) of a firearm has an elongated tubular body (14) with a leading end (16), a trailing end (18) and a passage (100) extending through the body (14) and opening onto the leading end (16). An insert (102) is disposed in the passage (100). A cavity (20) is formed in the body (14) between the insert (102) and the trailing end (18) for holding a volume of propellant. A seal arrangement (22) is formed on the body (14) and located between and in-board of the leading end (16) and the trailing end (18). The seal arrangement (22) extends circumferentially about body to form a substantial seal against an inner circumferential surface of the barrel (12). A driving band (28) is supported on the body (14) between the seal arrangement (22) and the trailing end (18) and arranged to maintain substantial coaxial alignment of the body (14) of the projectile and the barrel (12) of the firearm while the projectile travels along the barrel (12). The driving band (28) has one (Continued)

or more flow paths (38) that enable fluid communication between opposite axial ends of the driving band (28).

29 Claims, 6 Drawing Sheets

(58) Field of Classification Search
USPC ..... 102/519
See application file for complete search history.

(56) References Cited

U.S. PATENT DOCUMENTS 468,621 A * 2/1892 Holmes ..... F42B 14/02 102/527
642,762 A * 2/1900 Stubbs et al. ..... F42B 14/02 102/526
740,977 A * 10/1903 Hamilton ..... F42B 12/06 102/519
922,573 A * 5/1909 Gatham ..... F42B 12/06 102/519
1,341,844 A * 6/1920 Dougan ..... F42B 10/16 244/3.23
2,246,429 A * 6/1941 Brandt ..... F42B 12/625 102/519
3,169,333 A * 2/1965 Scanlon, Jr. ..... F41A 19/57 42/69.01
3,442,205 A * 5/1969 Gawlick ..... F42B 10/34 102/503
3,476,049 A * 11/1969 Gawlick ..... F42B 10/34 102/503
3,695,181 A * 10/1972 Bull ..... F42B 14/064 102/522
3,732,819 A * 5/1973 Quinlan ..... F42B 5/34 102/433
3,910,194 A * 10/1975 Dehm ..... F42B 14/02 102/527
4,366,015 A * 12/1982 Murray ..... F42B 14/02 102/527
6,237,497 B1 5/2001 Altenau et al.
7,568,433 B1 8/2009 Farina et al.
7,578,238 B1 * 8/2009 Dabiri ..... F42B 10/40 102/374
8,573,129 B1 * 11/2013 Smitchko ..... F42B 14/02 102/524
2006/0027128 A1 2/2006 Hober
2009/0178585 A1 * 7/2009 Harrison ..... F42B 30/02 102/380
2016/0131465 A1 * 5/2016 Harrison ..... F42B 14/02 102/439

OTHER PUBLICATIONS

International Preliminary Report on Patentability for Application No. PCT/AU2018/050527 dated Feb. 14, 2019 (21 pages).

* cited by examiner

SINGLE SEAL PROJECTILE

TECHNICAL FIELD

This document discloses a projectile for firing, particularly but not exclusively, from a barrel of a firearm.

BACKGROUND ART

A bullet is a well-known form of a projectile for firing form a from a barrel of a firearm. To form a complete round of ammunition the bullet is frictionally or otherwise mechanically engaged with an open end of a case which holds a supply of propellant. This engagement is by inserting a tail portion of the bullet inside the open end of the case and then using the tension of the case neck or crimping the case onto an outer circumference of the bullet to retain the bullet in the case until fired. An opposite end of the case is formed with a planar base wall that seats a primer.

Typically, a press is used to push bullet a predetermined distance into the case from the open end. The open end of the case may be crimped over a portion of the bullet or into a cannelure on the bullet. An opposite end of the case is formed with a planar base wall that seats a primer.

When the ammunition round is used the primer is usually initiated mechanically by striking with a firing pin. This in turn causes deflagration of the propellant. Deflagration of the propellant results in the rapid generation of a large volume of gas. This gas expels the projectile from the case and propels the projectile through the barrel of a firearm or other firearm from which the round is fired.

The bullet has a bearing surface which is the portion of the surface having a diameter sufficient to seal against the outer bore of the barrel and in doing so, engage rifling on the inside of the barrel. The engagement of the bearing surface with rifling imparts angular momentum to the projectile which is critical in keeping in-flight stability and accuracy; as well as maintaining gas pressure behind the bullet.

Factors which are critical to the performance of a bullet or other like projectile include but are not limited to: the length and weight of the projectile itself, the volume of propellant used to propel the projectile through the barrel, the length of the bearing surface, and length of the bullet inside the case prior to firing. There is generally a trade-off between these factors. For example, increasing the mass of the bullet often requires the overall length of the bullet to be increased. However, this increased length reduces the volume of propellant held in the case because the increased length of the bullet is accommodated within the case. Therefore, while mass increases the reduced propellant volume often leads to a reduced velocity and decreased range. Also, the kinetic energy of the projectile is related to the mass times its velocity squared. Therefore, reducing velocity has a greater effect on decreasing kinetic energy than the increase in kinetic energy provided by increased mass.

Reducing weight of the projectile to increase velocity can be achieved by forming a cavity or hollow in the projectile. However, care must be taken when doing this because the pressure of the deflagration propellant can radially expand the body of the projectile around the cavity so that it presses against the inner surface of the barrel acting as a brake and therefore reducing muzzle velocity.

Having a relatively large bearing surface is beneficial in terms of stability of the projectile in the barrel and thus overall accuracy. However, the increased bearing surface also increases friction against the surface of the barrel being to increase generation of heat and reduction of kinetic energy of the projectile.

SUMMARY OF THE DISCLOSURE

In a first aspect there is disclosed a projectile for firing from a barrel of a firearm comprising:

- an elongated tubular body having a leading end and a trailing end and a passage extending through the body and opening onto the leading end;
- an insert disposed in the passage;
- a cavity in the body between the insert and the trailing end capable of holding a volume of propellant for propelling the projectile through a barrel of a firearm;
- a seal arrangement formed on the body and located between and in-board of the leading end and the trailing end, the seal arrangement extending circumferentially about body to form a substantial seal against an inner circumferential surface of the barrel;
- a driving band supported on the body between the seal arrangement and the trailing end and arranged about the body in manner to maintain substantial coaxial alignment of the body of the projectile and the barrel of the firearm while the projectile travels along the barrel, the driving band having one or more flow paths that enable fluid communication between opposite axial ends of the driving band.

In a second aspect there is disclosed a projectile for firing from a barrel of a firearm comprising:

- an elongated tubular body having a leading end and a trailing end and a passage extending through the body and opening onto the leading end and the trailing end;
- an insert disposed in the passage; and
- a cavity in the body between the insert and the trailing end capable of holding a volume of a propellant for propelling the projectile through a barrel of a firearm.

In one embodiment of either aspect the passage has an inner diameter smaller than an inner diameter of the cavity.

In one embodiment of either aspect the projectile comprises a seat inside the body and wherein the insert is provided with a shoulder configured to come into face to face abutment with the seat.

In one embodiment the seat is formed with a tapered surface transitioning the inner diameter of the passage to the inner diameter of the cavity.

In one embodiment of either aspect the insert is arranged to extend beyond the leading end of the body and form a tip of the projectile.

In one embodiment of either aspect the insert and the body are configured so that together the projectile is formed with: (a) a ballistic tip; or (b) a hollow tip.

In an alternate embodiment of either aspect the projectile comprises a tip separate from the insert, wherein the tip is configured to engage the passage from the leading end of the body.

In the alternate embodiment the passage, tip and insert may be relatively dimensioned so that when the tip is engaged with the passage and the insert is seated in the passage, a space or cavity is formed between the tip and the insert. In such an embodiment the tip and the body may be configured so that the projectile is formed with either a ballistic tip or a hollow tip. Additionally, the tip and the insert may be made from dissimilar materials from each other.

Also, in an embodiment of either aspect the insert and the body may be made from dissimilar materials from each other.

In a third aspect there is disclosed a projectile for an ammunition round for firing from a barrel of a firearm comprising:

an elongated body having a leading end, an axially aligned trailing end, and an internal cavity extending between the leading end and the trailing end, the cavity being capable of holding a quantity of propellant for propelling the projectile;

a seal arrangement formed on the body and located between and in-board of the leading end and the trailing end, the seal arrangement protruding radially from an outer circumferential surface of the body to form a substantial seal against an inner circumferential surface of the barrel;

a driving band supported on the body between the seal arrangement and the trailing end, and wherein the body has a rearward portion that extends from the driving band to the trailing end, the driving band extending circumferentially about the body and having an outer circumferential surface which has a maximum outer diameter arranged to contact at least a portion of the inner circumferential surface of the barrel; and one or more flow paths that enable fluid communication across the driving band between the single seal and the rearward portion of the body.

In an embodiment of any of the above aspects the driving band comprises one or more ring like structure extending about a longitudinal axis of the body and the flow paths comprise one or more gaps or recesses an outer circumferential surface of the ring like structure.

In one embodiment the driving band has an outer radius which varies about the longitudinal axis between a maximum outer radius and a minimum outer radius which is less than the maximum outer radius and equal to or greater than an outer radius of the body immediately adjacent the driving band.

In an alternate embodiment the driving band comprises one or more ring like structures extending about a longitudinal axis of the body and the flow paths comprise holes formed axially in the driving band radially inside of an outer circumference surface of the driving band.

In a further alternate embodiment, the driving band comprises at least one of a: (a) knurled outer surface; (b) plurality of ribs that extend along the body; and (c) a plurality of protrusions on the body.

In one embodiment of any aspect a bounded portion of the body between the seal arrangement and the driving band has a continuous outer circumferential surface and forms a barrier for fluid communication in a radial direction through the body for an entire length of the bounded portion.

In one embodiment of the first or second aspects the body has a rearward portion that extends from the driving band to the trailing end, the rearward portion configured to enable fluid communication between the structural integrity structure and the trailing end.

In an embodiment of the third aspect at least a part of the rearward portion of the projectile body is formed with a reducing outer diameter.

In one embodiment of any aspect a portion of the cavity leading to the trailing end has a progressively increased inner diameter.

In an embodiment of the second aspect the projectile comprises a seal arrangement formed on the body and located between and in-board of the leading end and the trailing end, the seal arrangement protruding radially from an outer circumferential surface of the body to form a substantial seal against an inner circumferential surface of the barrel.

In one embodiment of any aspect the body and the sealing arrangement are formed as a single integral unit and the sealing arrangement is fixed from axial motion relative to the body.

In one embodiment of any aspect the body and the driving band are formed as a single integral unit and the sealing arrangement is fixed from axial motion relative to the body.

In one embodiment of any aspect the body, the sealing arrangement and the driving band are formed as a single integral unit and the sealing arrangement is fixed from axial motion relative to the body.

In a fourth aspect there is disclosed an ammunition round comprising:

a projectile according to any one of the first, second or third aspects;

a quantity of propellant held in the cavity;

a base seal closing the trailing end to confine the propellant in the cavity; and, a primer supported in the base seal.

In a fifth aspect there is disclosed an ammunition round comprising:

a projectile according to any one of the first, second or third aspects;

a case sealed at one end by a base, the case fitted over a portion of the projectile body with the base facing the trailing end of the projectile and closing the cavity; and a quantity of propellant retained within the cavity by the case, and wherein the leading end of the projectile protrudes from the case.

In one embodiment ammunition round the case and the projectile body are relatively dimensioned so that the case at least partially overlies the seal arrangement.

In one embodiment of the ammunition round the quantity of propellant is such that substantially the entire cavity is filled with the propellant.

In one embodiment of the ammunition round the projectile and the case are relatively dimensioned such that a space is formed between the trailing end of the projectile body and the base of the case and wherein the propellant is retained between an inner surface of the cavity and the base of the case.

In one embodiment of the ammunition round the propellant is provided in a volume greater than that of the space so that at least a proportion of the propellant is held in the cavity.

In one embodiment of the ammunition round wherein the propellant is provided in a volume to substantially fill the space and the cavity.

BRIEF DESCRIPTION OF THE DRAWINGS

Notwithstanding any other forms which may fall within the scope of the projectile and corresponding ammunition round as set forth in the Summary, specific embodiments will now be described, by way of example only, with reference to becoming drawings in which.

DETAILED DESCRIPTION OF SPECIFIC EMBODIMENTS

Figure 1:
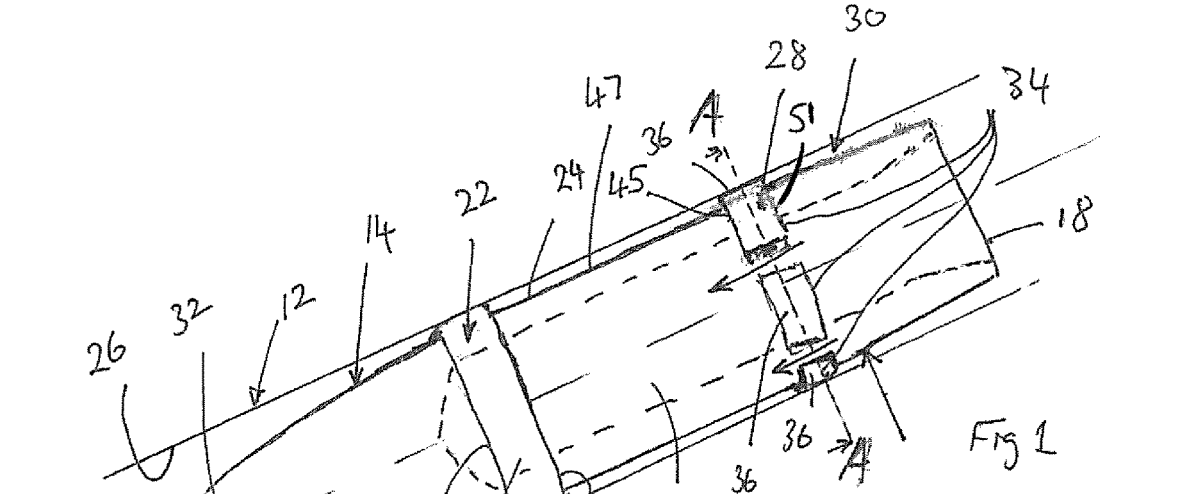
FIG. 1 is a schematic representation of an embodiment of a first aspect of the disclosed projectile in the barrel of a firearm.
Figure 2:
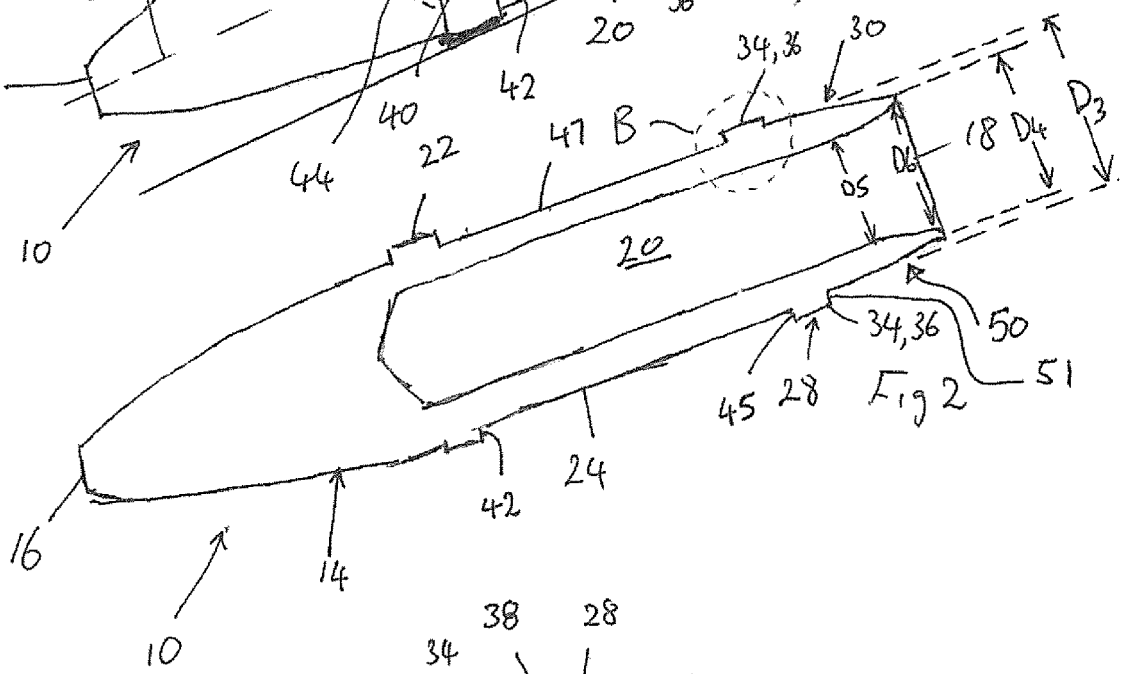
FIG. 2 a longitudinal section view the first embodiment of the projectile shown in FIG. 1.
Figure 3:
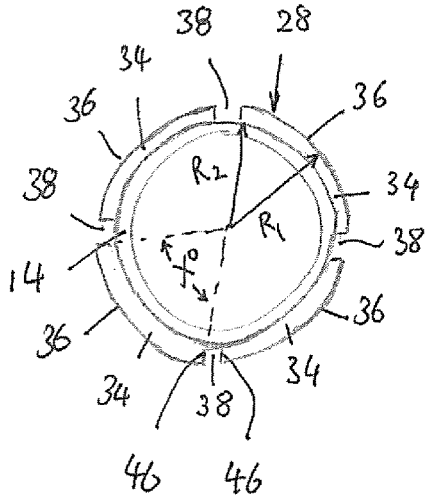
FIG. 3 is a view of section A-A of the first embodiment of the projectile shown in FIG. 1.

FIGS. 1-3 depict an embodiment of a first aspect or form of the disclosed projectile 10 for firing from a barrel 12 of a firearm (not shown). The projectile 10 has an elongated body 14 with a leading end 16, an axially aligned trailing end 18, and an internal cavity 20 extending between the leading end 16 and the trailing end 18. The cavity 20 is capable of holding a quantity of propellant for propelling the projectile 10. This embodiment of the projectile 10 is for a non-explosive ammunition round. That is the projectile of this embodiment relies on its kinetic energy to produce an effect on a target rather than the detonation of an explosive charge carried by the projectile to the target.

The body 14 is open at the trailing end 18 to allow filling of the cavity 20 with propellant. However as explained later prior to use the trailing end 18 is closed either directly by a base seal or cap having a primer, or alternately in another embodiment by a case which receives a portion of a length of the body 14.

A seal arrangement 22 is formed on the body 14 located between and in-board of the leading end 16 and the trailing end 18. The seal arrangement 22 protrudes radially from an outer circumferential surface 24 of the body 14 to form a substantial seal against an inner circumferential surface 26 of the barrel 12. The seal arrangement 22 is intended to engage rifling formed in the barrel to impart spin and angular momentum to the projectile thereby providing stability in flight. This also avoids the need for fins or other external surfaces for providing flight stability.

A driving band 28 is supported on the body 14 between the seal arrangement 22 and the trailing end 18. The driving band 28 is arranged about the body 14 in manner to maintain substantial coaxial alignment of the body 14 of the projectile 10 and the barrel 12 of the firearm while the projectile travels along the barrel. This can be achieved by arranging the driving band circumferentially about a longitudinal axis 32 of the projectile body. The driving band may take many different forms including a ring like structure 29 as shown in FIGS. 1-3. However other forms which are discussed later may include ribs, a knurled surface, or a plurality of protrusions.

The driving band 28 in this embodiment is inboard of the trailing end 18 so that the body 14 is formed with a rearward portion 30 that extends from the driving band 28 to the trailing end 18. At least some portions 34 of the driving band 28 have outer circumferential surface 36 arranged to contact the inner circumferential surface 26 at circumferentially spaced points. This helps keep the coaxial alignment of the projectile with the barrel and may also result in the driving band engaging the rifling to impart spin to the projectile 10.

The driving band 28 and thus the projectile 10 is also formed with one or more flow paths 38 that enable fluid communication between the seal arrangement 22 and the trailing end 18. This enables pressure equalisation between regions inside and outside of the projectile body while the projectile is travelling along the barrel 12. Thus, the gas pressure generated by deflagration of propellant within the projectile body can be conducted from within the projectile body from the trailing end 18 up to a trailing edge of the seal arrangement 22.

The deflagration gas will also naturally flow across the rearward portion 30 of the body and the driving band 28. Thus, when the projectile 10 is being fired from firearm and travels along the barrel 12 gas generated by the deflagration of the propellant within the cavity 20 can flow from the trailing end 18 across the rearward portion 30 through the flow paths 38 to the seal arrangement 22. Therefore, pressure is equalised within the barrel 12 rearward of the seal arrangement 22 inside and the outside of the cavity 20.

The significance of this is that there is no substantive pressure differential between the inside and outside of the cavity 20 within the barrel 12 behind the seal arrangement 22. Therefore, the portion of the body 14 which is provided with the cavity 20 can be formed with a very thin wall because it is not requirement to contain a substantial pressure differential. This in turn leads to the ability to make the projectile 10 exceptionally light in weight and provide greater volume in the cavity 20 for holding propellant. Both factors have a beneficial effect on the muzzle velocity of the projectile 10.

In this embodiment the seal arrangement 22 is in the form of a single sealing band 40 that extends completely about (i.e. for a full revolution of) the longitudinal axis 32 of the projectile 10 and body 14. The seal arrangement 22 has a trailing or pressure edge 42 and an opposite leading edge 44. In this instance because the seal arrangement 22 is in the form of a single band 40 the axial width of the band 40 is the same as the axial distance between the edges 42 and 44.

Figure 4:
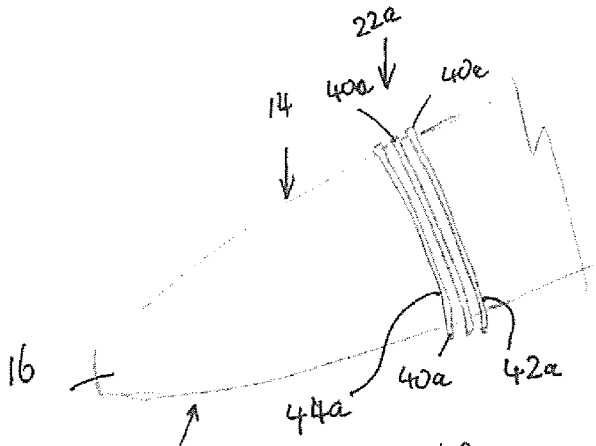
FIG. 4 the schematic representation of a leading portion of a second embodiment of the disclosed projectile incorporating a different seal arrangement to that shown in the first embodiment.
Figure 5:
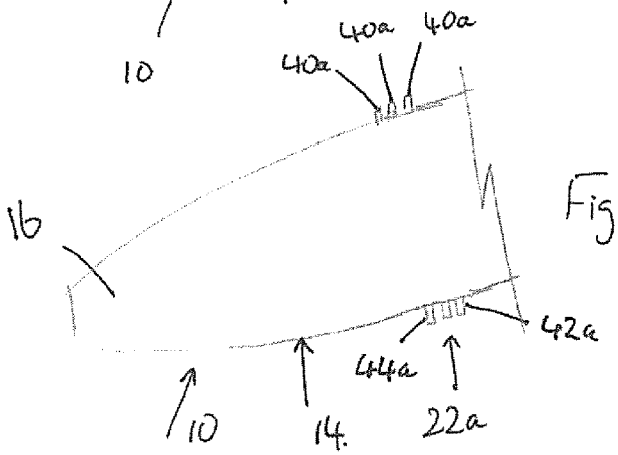
FIG. 5 is a section view of the leading portion of the projectile shown in FIG. 4.

However other embodiments of the seal arrangement 22 are possible. For example, FIGS. 4 and 5 depict an alternate seal arrangement 22*a* the form of a plurality of closely spaced sealing bands 40*a*. The seal arrangement 22*a* has a pressure edge 42*a* and a leading edge 44*a*. These edges are on different sealing bands 40*a*. Each sealing band 40*a* has a smaller axial length than the single sealing band 40. Nonetheless it is possible for the axial length of the seal arrangement 22*a* to be the same as that of the seal arrangement 22. A benefit of forming a seal arrangement 22 as a plurality of relatively narrow width seals is that the total contact surface area for the seal arrangement 22*a* is less than that for the seal arrangement 22 thereby reducing friction with the barrel 12.

In the embodiment of the projectile 10 shown in FIGS. 1-3 the flow paths 38 which enable pressure equalisation on opposite sides of the cavity 20 are provided by or formed as gaps or recesses in the outer circumferential surface 36 of the driving band 28. In this embodiment the driving band 28 can be considered to be similar to the seal arrangement 22 but with gaps or recesses formed in the in the outer circumferential surface that extend between axially opposite edges.

Embodiments of the projectile 10 can be made by many different manufacturing techniques including but not limited to moulding and machining. If the projectile 10 is made by a moulding process the gaps or recesses 38 may be formed by the provision of a core piece at the location of the required gaps 38. If the projectile 10 is made by machining process the gaps 38 can be produced by milling material from a circumferential band of material which constitutes the driving band. The method forming the gaps or recesses 38 is of no significance to the various embodiments of the disclosed projectile.

The seal arrangement 22 may be formed integrally with the body 14 as a single or one-piece structure. The driving band 28 may also be formed integrally with the body 14 as a single or one-piece structure. Thus, embodiments of the disclosed projectile 10 may comprise a body 14, sealing arrangement 22 and driving band(s) 28 formed as a single piece integral unit. This facilitates manufacture of the body 14, seal arrangement 22 and driving band 28 of the projectile 10 from the same material. In such embodiments the seal 22 is fixed against movement relative to the body 14. Similarly, the driving band is fixed against movement relative to the body 14.

As is most apparent from FIG. 3 in this embodiment the driving band 28 has an outer diameter which varies about the longitudinal axis between a maximum radius R1 and a minimum radius R2 both measured from the longitudinal axis 32. The maximum radius R1 is such that the surface 34 of the driving band contacts the inner circumferential surface 26 of the barrel 12. The minimum radius R2 is equal to or greater than the radius of the body 14 on its outer surface immediately adjacent the driving band.

In the driving band currently illustrated there is a step change between the radii R1 and R2. Accordingly, the gaps 38 are formed between planar mutually facing surfaces 46.

The driving band 28 may be considered as being composed of N segments (i.e. the portions 34 constitutes segments) where N is an integer greater than or equal to 2 which are spaced apart by the same number of gaps or recesses 38. Each sector extends for a maximum arc angle of X° where X°<360/N° having the maximum radius R1. In one embodiment each of the segments extends for the same arc angle X° and are equally spaced apart by respective gaps 38. The gaps 38 form, and can be considered as, or at least a part of, a flow path enabling the conduction of gas pressure generated by deflagrating propellant from the trailing end 18 to the sealing arrangement. Thus, the portion of the body 14 that coincides with the substantive length of the cavity 20 is subjected to substantially equal gas pressure from within and outside of the cavity 20 as it travels along the barrel.

Having the driving band 28 contact the inner circumferential surface 26 of the barrel 12 at two or more equally circumferentially spaced apart locations helps in the stability of the projectile 10 when travelling through the barrel 12 and thus assist in maintaining accuracy.

With reference to FIG. 2 the driving band 28 has a leading edge 45 which faces the trailing edge 42 of the seal arrangement 22. The trailing edge 42 and the leading edge 45 may be axially spaced by a distance equal to or greater than the caliber of the projectile 10.

For convenience a region of the body 14 between the edges 42 and 45 is referred to as the "bounded portion". The bounded portion of the body 14 has a continuous outer circumferential surface 47. The bounded portion also circumscribes a portion of the cavity 20. By forming the bounded portion with a continuous outer circumferential surface, it is not possible for gas from the deflagrating propellant in the cavity 20 to radially pass through the bounded portion of the body 14 to provide pressure equalisation between the inside and outside of the cavity 20. The pressure equalisation between inside of the cavity 20 and the region between an inner circumferential surface 26 of the barrel 12 and the outer circumferential surface of the body 14 and the bounded portion is only by fluid communication through the flow paths 38.

Figure 6A:
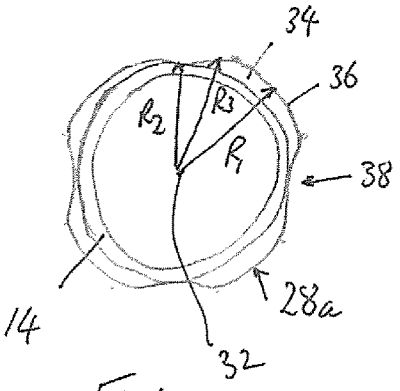
FIG. 6*a* is a schematic representation of a cross-section view through a driving band of a third embodiment of the disclosed projectile.

As mentioned above, other forms of driving band 28 are possible. For example, FIG. 6*a* shows an alternate form of driving band 28*a* in which the radius of the circumferential outer surface 36 of the band 28 varies in a smooth or sinusoidal like manner so that portions of the driving band 28 have a radius R3 where: R1>R3>R2.

Figure 6B:
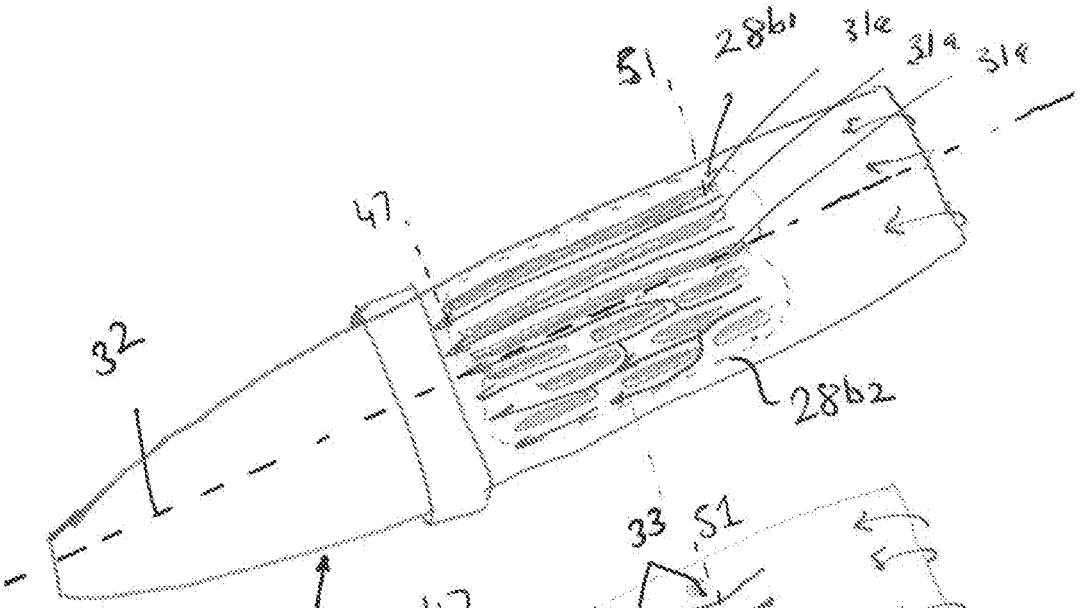
FIG. 6*b*-6*d* depict further alternate configurations of the driving band of a driving band applicable to embodiments of the disclosed projectile.

FIG. 6*b* shows two alternate forms of the driving band 28*b*1 and 28*b*2 as a plurality of ribs 31*a* or 31*b* respectively extending along the body 14 in general alignment with the longitudinal axis 32. The ribs 31*a* extend for the full length of the driving band 28*b*1. However, in the driving band 28*b*2 the ribs 31*b*2 are of a shorter length than the ribs 31*b*1 and arranged in spaced apart lines. In a further variation instead of the ribs 31*a*/31*b* running in alignment with the longitudinal axis 32, the ribs may follow a spiral path around the longitudinal axis 32. This may also aid in imparting angular momentum to the projectile both during travel through the barrel of the firearm and after exiting the barrel. Flow paths 38 between the ribs 31*a*/31*b* facilitated pressure conduction from the trailing end 18 to the sealing band and thus and pressure equalisation across the body for the substantive length of the cavity 20.

Figure 6C:
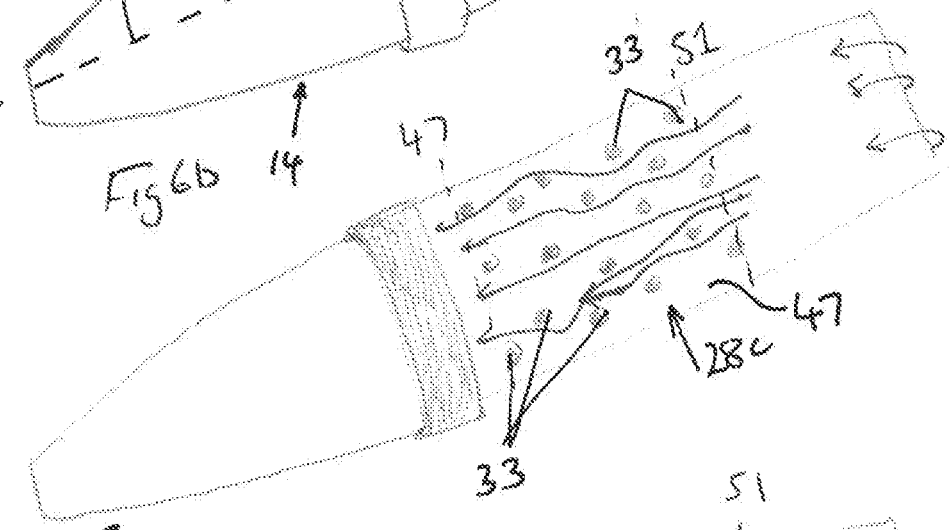

FIG. 6*c* depicts a form of driving band 28*c* composed of a plurality of projections 33 formed on the outer circumferential surface 47 of the body 14. The projections 33 are configured to support the projectile coaxially within the barrel 18. The projections 33 may be formed with convexly curved or domed free ends that contact the barrel 12. A plurality of gaps is formed between the projections 33 creating multiple fluid flow paths 38 for the deflagration gases.

Figure 6D:
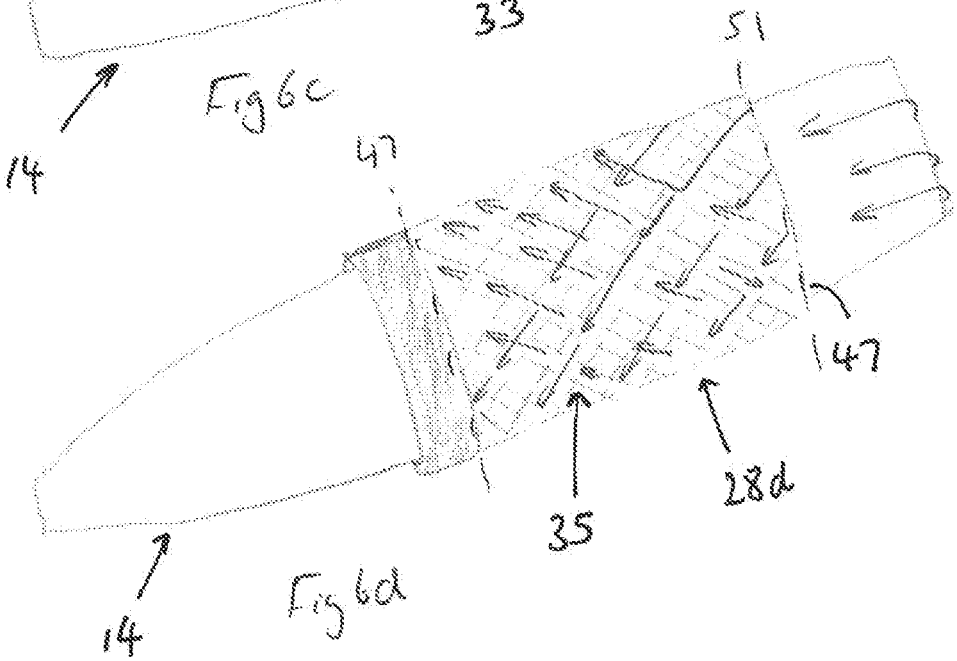

FIG. 6*d* depicts a further form of driving band 28*d* in which the outer circumferential surface 47 of the body 14 is knurled 35. The knurling is arranged to produce multiple flow paths 38 in different directions to facilitate the pressure conduction and pressure equalisation described above in relation to the earlier embodiments.

Figure 7:
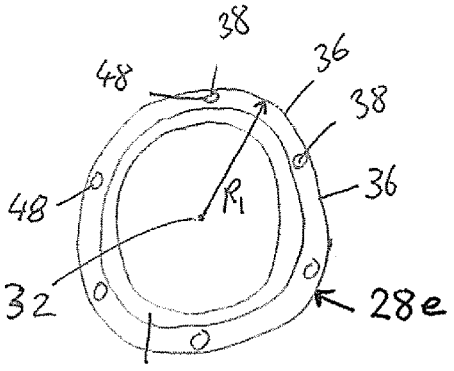
FIG. 7 is a schematic representation of a cross-section view through a driving band of a further embodiment of the disclosed projectile.

FIG. 7 depicts a further possible form of driving band 28*b*. Here the driving band 28*e* has an outer surface 36 at the radius R1 for a full revolution about the axis 32. Thus, the driving band 28*e* contacts the inner circumferential surface 36 for a full 360°. The flow paths 38 are created by holes 48 formed axially through the driving band 28*e*. The holes 48 lie inside of the maximum radius R1.

Figure 8:
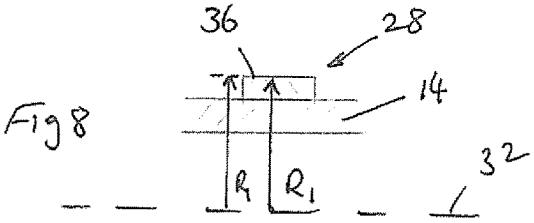
FIG. 8 is a view of detail B shown in FIG. 2 showing the profile of a driving band in the first embodiment of the projectile.
Figure 9:
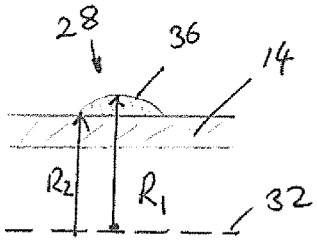
FIG. 9 is a section view of a fifth embodiment of the disclosed projectile shown a driving band of an alternate profile to that of the first embodiment.

As shown in FIG. 2 at detail B one embodiment of the driving band 28 has its outer circumferential surface 36 formed with a constant radius R1 for the entirety of its axial length. This is also shown in FIG. 8. However, in an alternate embodiment the outer circumferential surface 36 may be formed with a variable radius measured in the axial direction from the longitudinal axis 32. This is depicted most clearly in FIG. 9. Here the driving band 28 has an outer circumferential surface 36 that has a curved profile in the axial direction. Thus, the outer surface 36 varies in its radial extent from the longitudinal axis the two between a maximum radius R1 and the minimum radius R2. This provides minimal contact area between the driving band and the barrel 12 thereby reducing friction while maintaining the benefits of stability.

Different embodiments or forms of the driving band may have the same or different axial length along the body 14. For example, the ring like driving band 28 of FIGS. 1 and 2 have a relatively small axil length (from edge 47 to edge 51) in comparison to the driving bands 28*b*1, 28*b*2, 28*c* and 28*d* of FIGS. 6*b*-6*d*.

Returning to FIG. 2 the rearward portion 30 of the body 14 is formed with an outer diameter that progressively reduces from a maximum diameter D3 to a minimum diameter D4 in the direction from the driving band 28 to the trailing end 18. This produces what is known in the art as a "boat tail". The boat tail reduces turbulence and thereby improves the aerodynamics of the projectile 10. The maximum diameter D3 may be equal to the diameter of the projectile body 14 between the seal arrangement 22 and a driving band 28. This diameter is less than the diameter of the barrel 12.

It should be understood however that alternate embodiments of the projectile 10 do not require that the diameter of the rearward portion 30 reduces in the manner described above. The portion 30 can have a diameter which is constant for the entirety of its axial length.

Staying with FIG. 2 a portion 50 of the cavity 20 leading to the trailing end 18 has a progressively increased inner diameter. In particular the portion 50 has a minimum diameter D5 which coincides with the diameter of the majority of the length of the cavity 20, but progressively increases to a maximum diameter D6 at the trailing end 18. This variation in the diameter of the cavity 20 assists in the process of filling the cavity 20 with propellant as well as reducing the projectile mass, increasing cavity volume (and thus the total volume of propellant capable of being held in the cavity) and moving the centre of mass of the projectile further forward.

The projectile 10 can be formed into a round of ammunition by loading a quantity of propellant into the cavity 20 through the trailing end 18 and subsequently closing the end 18 with a base seal or cap provided with a primer. In this event the round of ammunition is a caseless. This is described in greater detail later with reference to FIG. 14.

Figure 10:
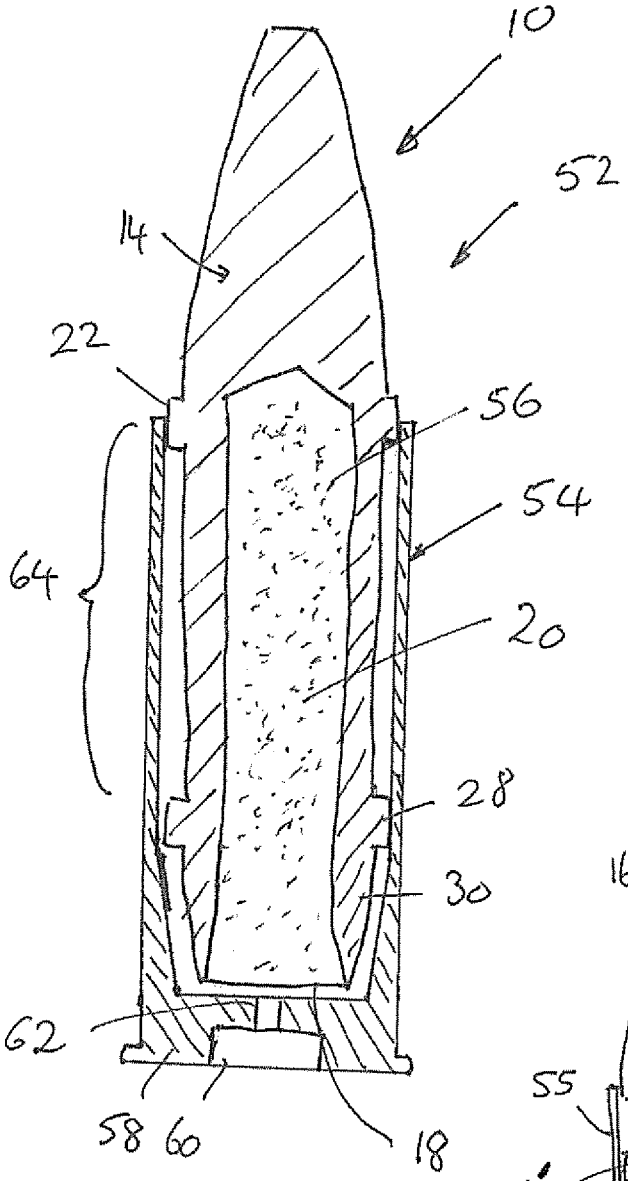
FIG. 10 is a section view of one form of round of ammunition incorporating a case and an embodiment of the projectile.

Alternately the projectile 10 can be formed into a cased round of ammunition 52 by engaging it with a case 54 as shown in FIG. 10. The cavity 20 of the projectile 10 is filled with a propellant 56. The trailing end 18 of the projectile 10 is in substance sealed or closed by the case 54. The case 54 has a base 58 formed with a recess 60 for receiving a primer. A flash hole 62 extends from the recess 60 into the interior of the case 54 to enable propagation of a flame from the primer 60 into the cavity 20 to initiate deflagration of the propellant 56.

In this embodiment the case 54 has a section 64 of substantially constant inner diameter which extends from the driving band 28 to the seal arrangement 22. The end of the section 64 distant the base 58 partially extends over the driving band 22. An interior portion of the case 54 between the section 64 and the base 58 is tapered to reduce in diameter to substantially follow the change in diameter of the rearward portion 30 of the projectile body 14.

In the round 52 the seal arrangement 22 and the driving band(s) 28 are arranged relative to the case 58 so that the projectile body 14 is securely gripped by the neck of the case 54 in which it is inserted and have its longitudinal axis 32 coincident with the longitudinal axis of the case 54. This is shown in FIG. 10 where the length of a section 64 the case 54 is greater than the distance between the facing circumferential edges of the seal arrangement 22 and the driving band 28.

Figure 11:
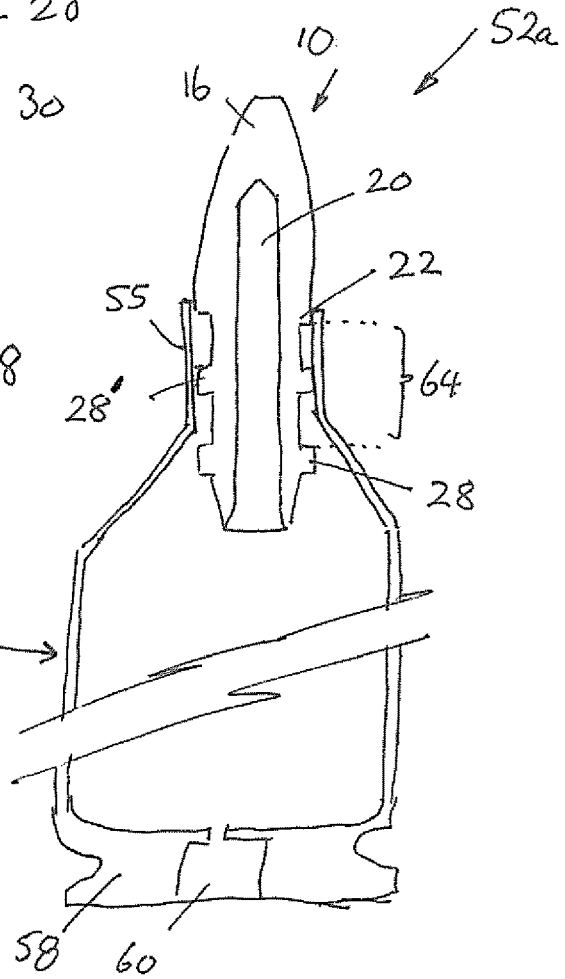
FIG. 11 is a section view of another form of a round of ammunition incorporating a case different to that shown in FIG. 10 and a seventh embodiment of the disclosed projectile.

However, if the length of the section 64 is shorter than the above-mentioned distance so that the case 54 only extends over the single driving band 28 the projectile may not be adequately gripped by the case and/or are not sit concentrically with the case which may give rise to accuracy issues. This may arise for example when the projectile is used with a necked case 54*a* to form a cased round 52*a* as shown in FIG. 11.

The cased round 52*a* differs from the cased round 52 by having a case 54*a* with a neck 55 in which the projectile is seated and the addition of a second driving band 28'. The driving band 28' is located between the driving band 28 and the seal arrangement 22. More particularly, the second driving band 28' is contacted by the case 54*a*. Also, although not specific or limited to this embodiment the seal arrangement 22 is formed as a stepped shoulder at and forming a trailing edge of the leading end/tip 16, rather than the "twin" shoulder seal arrangement 22 as shown in the earlier embodiments.

In general terms, for a cased round of ammunition the case and the projectile are arranged so that the projectile 10 contacts the inside of the case 52/52*a* at at least two axially spaced locations, with one of these being at the seal arrangement 22. For example, this can be achieved as shown in FIG. 10 by the provision of a single driving band 28 and a seal arrangement 22; or by the arrangement shown in FIG. 11 where two axially spaced apart driving bands 28 and 28' are provided on the projectile 10, both being within the case 54*a* but with the seal arrangement 22 and the intermediate driving band 28' in contact with the inside surface of the case 54*a*, at the neck 55. While the driving band 28 is within the case it lies outside of the neck 55 prior to firing. Contact between the projectile 10 and the case 54*a* is provided at two axially spaced locations coinciding with the seal arrangement 22 and the driving band 28' ensures the projectile 10 is tightly gripped and concentrically located within the case 54*a*. On firing, the projectile 10 is ejected from the case 54*a* and the driving band 28 may during this process contact the inside surface of the neck 55. In any event, the driving band 28 will contact the inside surface 26 of the barrel 12.

A further variation which may be considered as a hybrid of the above two is where the projectile 10 has two or more axially spaced apart driving bands and a seal arrangement, all of which contact the inside of the case.

Each of the above described embodiments of the projectile 10 can be formed either as a standalone ammunition by the provision of a base seal or end cap with a primer; or alternately provided as a part of a cased ammunition round 52 in which the projectile 10 is mated with a case or cartridge 54. The case/cartridge 54 can be configured to match the breach of any conventional firearm. In this way the same projectile 10 can be for use with firearms having different breach configurations by simply mating it with a case 54 configured to suit that breach.

The length of the rearward portion 30 is ≥40% of D3. In one embodiment the length of the rearward portion 30 can be in the order of 0.4D3 to D3. Such length provides sufficient length to form a boat tail and/or enable the projectile 10 to be seated with its trailing end 18 adjacent the inside of a case 54 in a cased version of the correspond ammunition. Also, the provision of the rearward portion 30 provides the overall length of the projectile to be increased while still maintain a boat tail or the ability to seat the trailing end 18 adjacent the inside of a case 54. The increased length in turn provides a greater cavity 20 volume for holding more propellant, and greater spacing between the trailing edge of the sealing arrangement 22 and the leading edge of a rearmost driving band to improve stability of the projectile while inside a barrel. The spacing between the trailing edge of the sealing arrangement 22 and the leading edge of a rearmost driving band 28 may be in the order of at least D3 but may also be more than 1.5×D3 and up to 3×D3.

Figure 12:
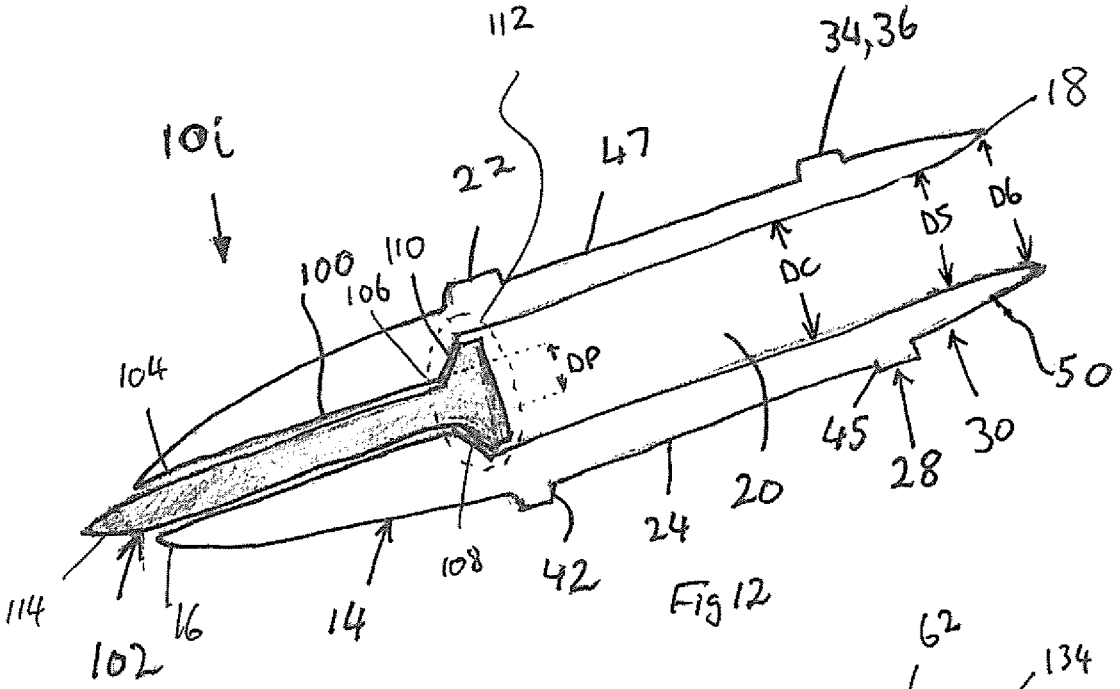
FIG. 12 is a schematic representation of a second aspect of the disclosed projectile which incorporates an insert to facilitate a modular projectile design concept.

FIG. 12 is a representation of the embodiment of the first form of the projectile shown FIG. 1 which has been modified to illustrate a modularisation concept. The projectile 10*i* shown in FIG. 12 has the same body 14, sealing arrangement 22, and driving band 28 is in the embodiment shown in FIG. 1 but in addition is formed with a passage 100 in the leading end 16. The passage 100 is formed as a continuation of the cavity 20 and opens onto the exterior surface of the leading end 16. An insert 102 is seated in and closes the passage 100.

It should be appreciated by those skilled in the art that the overall weight, ballistic characteristics, penetration characteristics and muzzle velocity of the projectile 10*i* can be changed while maintaining the shape and configuration of the body 14, by varying the shape, configuration, weight and material of the insert. That is, a body of a single shape and configuration can produce projectiles of different performance by using different types of inserts. This gives rise the modularisation concept where the one projectile body can be used to produce distinct types of projectiles by the use of different inserts.

It should also be clear to the persons skilled in the art that the modularisation concept is not limited to projectiles which also incorporate the above described driving band.

Thus, in a most general sense the modularisation concept may be manifested by a projectile for firing from a barrel of a firearm in which the projectile has:

- an elongated tubular body 14 with a leading end 16 and a trailing end 18 and a passage 100 extending through the body 14 and opening onto the leading end 16;
- an insert 102 disposed in the passage 100; and
- a cavity 20 in the body between the insert and the trailing end capable of holding a volume of a propellant for propelling the projectile 10*i* through a barrel 12 of a firearm.

The passage 100 has a front end 104 that opens onto the leading end 16 and a back end 106 that, in the absence of the insert 102 opens onto cavity 20. The passage 100 has an inner diameter DP which is smaller than an inner diameter DC of the cavity 20, i.e. DP<DC. The body 14 is also formed with a seat 108 against which the insert 102 abuts when it is fully inserted into the passage 100 from the trailing end 16. To this end the insert 102 is formed with a complimentary shaped shoulder 110. In this way the insert 102 is provided with a shoulder 110 configured to come into face to face contact or abutment with the seat 108. This face to face contact/abutment can occur in two ways. One way is during manufacture where the insert 102 is pressed in to the passage 100 from the trailing end 18 until there shoulder 110 abuts the seat 108. A second way, described later is where the insert 102 is only partially inserted into the passage 100, leaving a space or gap between the seat 108 and shoulder 110. This space subsequently closes upon initiation of the propellant which generates gas pressure to move the insert 102 forward relative to the body 14 until the shoulder 110 abuts the seat 108.

The seat 108 in this embodiment is formed in a transition zone 112 in the body 14 where the inner diameter DC of the cavity 20 transitions to the inner diameter DP of the passage 100. The transition zone 112 can be formed as a right-angle step. Alternately as shown in the accompanying Figures the transition zone 112 can be tapered or inclined to progressively and continuously reduce in inner diameter from DC to DP. The taper is selected so that the forces imparted on the insert 102 by the pressure of deflagrating propellant does not overcome the mechanical strength of the material selected for each component. This prevents or at least minimises the risks of (a) the insert 102 being ejected from the leading end 16 of the body 14, and (b) the outer portion of the body 14 near the leading end 16 and insert 102 being distorted by the forces.

In this embodiment the diameter DP this constant from the leading end 16 to the commencement of the transition zone 112. The diameter DC is constant for a length from the inward most end of the transition zone 112 (and indeed form the trailing end of the insert 102) to, or close to, the trailing end 18. In the embodiment shown in FIG. 12 there is a progressive increase in the inner diameter of the cavity 20 from D5 (which is the same as DC) to D6 at the trailing end 18 of the body, as in the embodiment of FIGS. 1-3.

The insert 102 and the body 14 are configured so that when the insert 102 is seated in the passage 100 it closes the passage 100 and forms a seal prevent the escape of gas generated by deflagration of the propellant from the leading end 16.

In the embodiment shown in FIG. 12 the insert 102 is configured or otherwise arranged to extend beyond the leading end 16 of the body 14 and form a tip 114 of the projectile 10*i*. Moreover, the insert 102 and the body 14 are relatively configured so that together the projectile 10*i* is formed with a high ballistic coefficient tip.

A feature of embodiments of the disclosed projectile 10*i* is that the same body 14 can be fitted with inserts 102 of different configuration, weight, or made from varied materials. For example, the insert 102 of the same shape and configuration as shown in FIG. 12 can be made from a plastics material, a composite material, steel, copper, or lead etc, totally independent of the material from which the body 14 is made. Accordingly, the weight of the insert 102 and thus the total weight and/or weight distribution of the projectile 10*i* can be varied by appropriate choice of the material from which the insert 102 is made. The volume of the cavity 20 and thus the volume of propellant stays the same when the overall configuration of the insert is the same.

Varying the material from which the inserts 102 is made, in addition to varying the weight, can vary the degree of penetration into the object. For example, the insert 102 can be made material having armour piercing characteristics.

Another variable aspect of the insert 102 is its length rearward of the seat 108. Increasing this length reduced the volume of the cavity and increases the overall weight of the projectile as well as its weight distribution.

Figure 13:
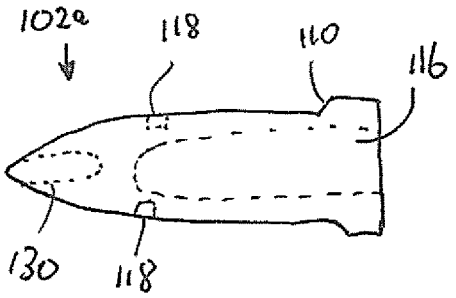
FIG. 13 is a schematic representation of an insert showing multiple different and mutually independent design variations that may be used to form alternate embodiments of projectile shown in FIG. 12.
Figure 15:
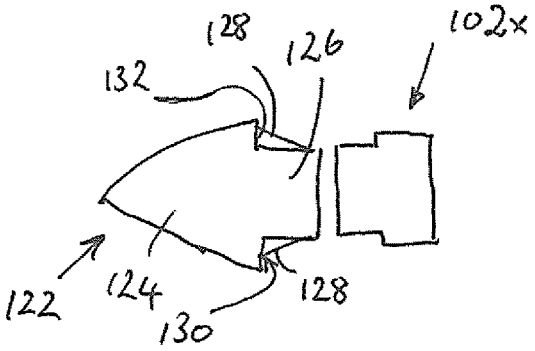
FIG. 15 is a schematic representation of a further possible form of insert and an associated projectile tip that may be used to form alternate embodiments of projectile shown in FIG. 12.

In a variation shown in FIG. 13 an insert 102*a* having the same general shape and length as the insert 102 is provided with an optional blind cavity 116 extending from its trailing end toward its leading end. The blind cavity 116 has the effect of giving additional volume to the cavity 20 for holding more propellant and simultaneously reducing overall weight of the insert 102*a* and projectile 10*i*.

The insert 102*a* of FIG. 13 is further shown with an optional cannelure 118 into which the leading end 16 of the body 14 can be crimped. In yet a further alternate embodiment the insert 102*a* can be provided with a hollow tip shown by phantom line 120, thus converting the projectile to a hollow tip projectile.

Figure 14:
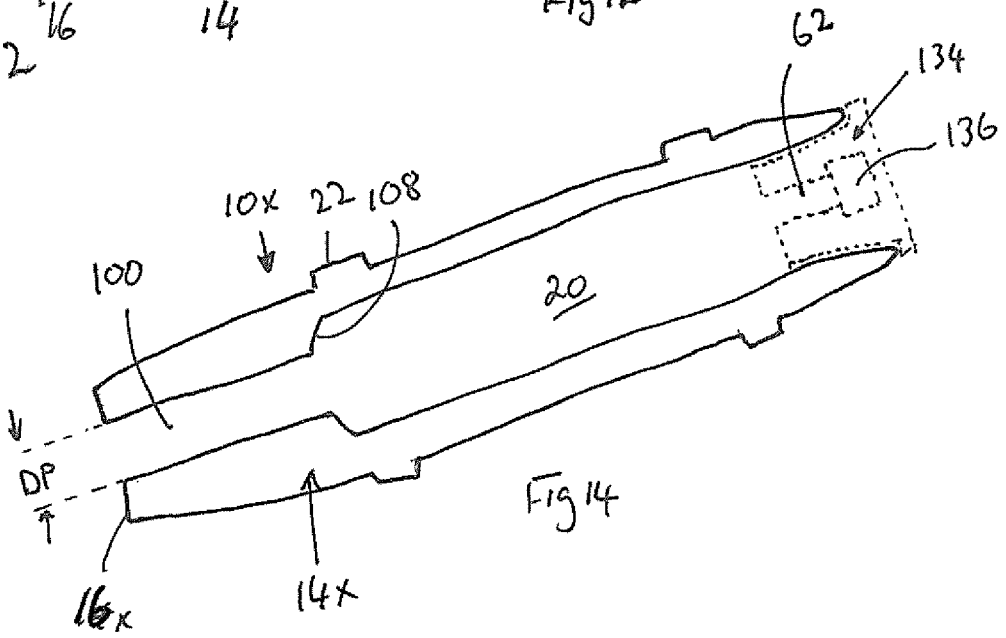
FIG. 14 is a schematic representation of a projectile body that may be used in an alternate embodiment of projectile shown in FIG. 12.

An insert 102/102*a* for the projectile 10*i* can be provided with: none; one; or, a combination of two or more of (a) blind cavity 116, (b) a cannelure 118, and (c) hollow tip 120. FIG. 14 illustrates an alternate embodiment of the projectile designated here as 10*x*. The reference numbers used to denote features of the projectile 10*i* are carried over to denote the same or similar features of the projectile 10*x* but with the replacement of the suffix "i" with the suffix "x".

The projectile 10*x* differs from the projectile 10*i* only by way of the configuration of the leading end 16*x* of the corresponding body 14*x*. For the projectile 10*x* the leading end 16*x* is flattened. In all other respects the projectile body 14*x* is the same as the projectile body 14. The features of the projectile 10*x* which are function in the same as those of the projectile 10*i* are denoted with the same reference number.

The projectile 10*x* may be fitted with an insert 102 or 102*a* similar to that shown in FIG. 12 and FIG. 13 respectively. However, in a further variation the projectile 10*x* may be provided with an insert 102*x* which seats in and closes the passage 100*x* at or near the back end 106. However, the length of the insert 102*x* is less than the length of the passage 100*x* and does not extend beyond the leading end 16*x* of the body 14*x*. This leaves the projectile body 14*x* with a hollow or recess opening onto the flattened leading end 16*x*.

Optionally a separate tip 122 can be inserted into the hollow or recess created by the passage 100*x*. The tip 122 is inserted from the leading end 16*x*. The tip 122 can be formed to have an aerodynamic head 124, and therefore provide to the projectile 10*x* with a high ballistic coefficient. Coaxial with the head 124 is a stub 126 that friction fits within passage 100*x*. To this end the stub 126 can also be formed with a plurality of fins or webs 128 that cut into the inside surface of the passage 100*x* form the leading end 16*x*.

A stepped shoulder 130 is formed between the head 124 and the stub 126. An annular planar surface 132 is formed as part of the shoulder 130. When the tip 122 is inserted into the passage 100*x* from the leading end 16*x* of the body 14*x* the planar surface 132 abuts the planar surface at the leading end 16*x*.

The insert 102*x* and the tip 122 can be configured so that there is a gap or space between them in the assembled projectile 10*x*. Alternately the insert 102*x* and the tip 122 can be relatively configured to abut each other in the assembled projectile 10*x*.

The insert 102*x* may be optionally formed with a cavity like the cavity 116 shown in FIG. 13. The tip 122 may optionally be formed with a hollow tip like the hollow tip 130 shown in FIG. 13. Tip 122 and the insert 102*x* can be made from the same or dissimilar materials.

Figure 16:
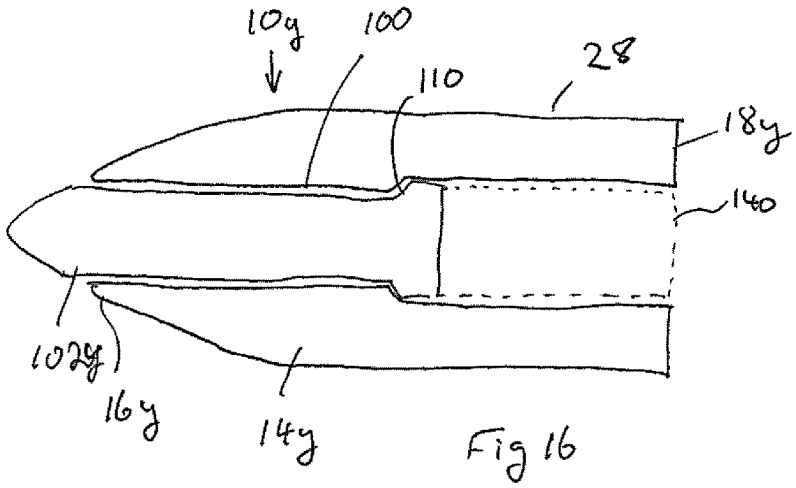
FIG. 16 is a schematic representation of a generalised form of another aspect of the disclosed projectile incorporating the modularisation concept.
Figure 17:
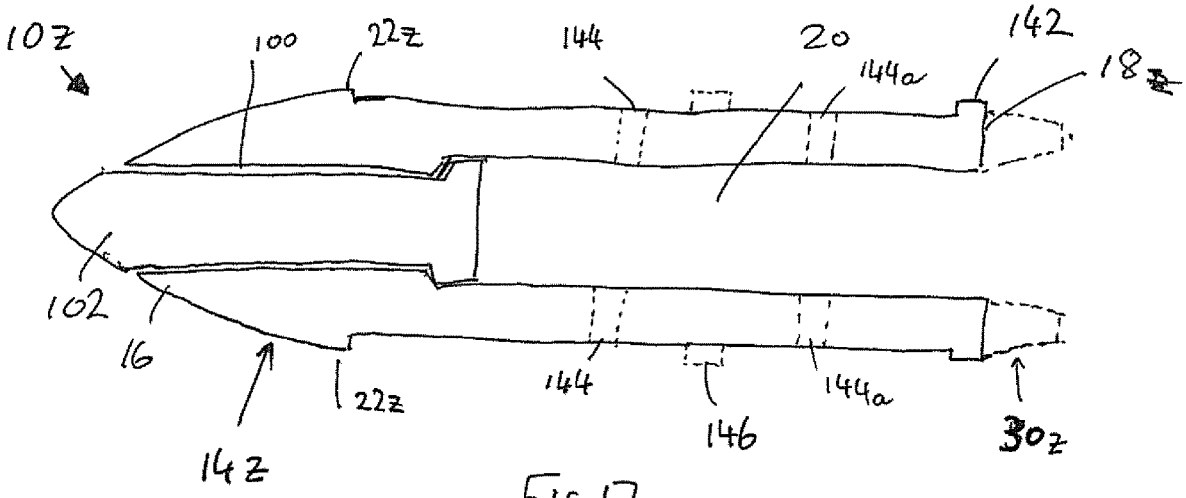
FIG. 17 schematically illustrates various design options available for the disclosed projectile incorporating the modularisation concept.

As previously mentioned the modular concept of the projectile facilitated by the insert 102 is not limited to use with projectiles that have a driving band 28 or indeed a body 14 of the same configuration as shown in FIGS. 1-15. FIGS. 16 and 17 describe alternate forms of the disclosed projectile.

FIG. 16 depicts a projectile 10*y* having a body 14*y* and an insert. The insert may be of the same form as insert 102, 102*a* and 102*x* as described above in connection with FIGS. 12-15. The body 14*y* has a cavity 20 and coaxial passage 100 for receiving the insert just like the earlier embodiments. However, the body 14*y* has a sealing arrangement 22 in the form of a bearing surface that extends continuously and smoothly from the leading end 16*y* without any clear or definite leading edge equivalent to the leading edge 44 of the sealing arrangement 22 shown in FIG. 1. Additionally, while the cavity 20 in the body 14*y* may be used to hold a volume of propellant, in another variation the insert 102 can be made of a shape and configuration that wholly occupies the cavity 20 as well as the passage 100. This is shown by the phantom line 140 being an extension of the insert 102 rearward of the shoulder 110. The extension is coterminous with the trailing end 18*y* of the body 14*y*.

FIG. 17 depicts a projectile 10*z* having a body 14*z* and an insert 102. The insert 102 can take the form of any one of the inserts 102, 102*a* and 102*x* described earlier in the specification. The body 14*z* has a leading end 16, a cavity 20 for holding a quantity of propellant, a passage 100 for receiving the insert 102, a forward sealing arrangement 22*z* and a structure 142 at or near the trailing end 18*z*. The body 14*z* is also depicted with optional features of:

- a second structure 144 located between the sealing arrangement 22*z* and the first structure 142;
- holes 144, 144*a;*
- rearward portion 50*z*.

In a general sense the projectile 10*z* has:

- an elongated tubular body 14*z* having a leading end 16 and a trailing end 18*z* and a passage 100 extending through the body 14 and opening onto the leading end;
- an insert 102 disposed in the passage 100;
- a cavity 20 in the body 14 between the insert 102 and the trailing end 18*z* and capable of holding a volume of propellant for propelling the projectile 10*z* through a barrel of a firearm;
- a seal arrangement 22*z* formed on the body 14 and located between and in-board of the leading end 16 and the trailing end 18, the seal arrangement extending circumferentially about the body to form a substantial seal against an inner circumferential surface of the barrel; and
- a structure 142 supported on the body between the seal arrangement 22*z* and the trailing end 18 and arranged about the body in manner to maintain substantial coaxial alignment of the body of the projectile and the barrel of the firearm while the projectile travels along the barrel. As described later the structure 142 may be in the form of a driving band having one or more flow paths that enable fluid communication between opposite axial ends of the driving band. Alternately if it is desired to provided pressure equalisation between the inside and outside of the cavity 20, the projectile 10*z* can be provided with optional holes 144, 144*a*.

As suggested above the structure 142 is arranged to keep stability of the projectile 10*z* as it travels along the barrel 12 of a firearm. This is achieved by forming the structure 142 with an outer diameter arranged to contact or otherwise engage the barrel of the firearm. Therefore, as the projectile 10*z* travels through the barrel 12 it is kept substantially coaxial with the barrel 12 due to the spaced contact with the body 14*z* at the sealing arrangement 22*z* and the structure 142, thereby avoiding or at least minimising wobble about a longitudinal axis of the barrel.

The structure 142 may be in the form of a seal or a driving band of the type described above with reference to FIGS. 1-9.

When in the form of a seal, the structure 142 contacts the inside surface of the barrel and forms a substantive seal preventing the bypass of gas generated by deflagration of propellant within the cavity 122. Because of the contact with the inside surface of the barrel, the structure 142 will also engage rifling within the barrel and thereby aid in generating spin. Optionally when the structure 142 is a seal, the body 14*z* may be provided with one or more holes 144 shown in phantom through which some of the propellant gas may bleed into a region between the exterior of the body 14*z*, from the seal 22*z* to the structure 142, and the interior of the barrel. This gives pressure equalisation between the inside of the cavity 20 and that region. Providing this pressure equalisation reduces the risk of the body 14*z* being expanded outward in a radial direction. This expansion occur could degrade performance of the projectile 10*z* if it results in additional portions of the body contacting the inside of the barrel and therefore increasing friction.

When the structure 142 is in the form of a driving band like the driving bands 28, 28*a*, 28*b*, 28*b*1, 28*b*2, 28*b*3, 28*d* or 28*e* described above, the structure 142 contacts the inside of the barrel while also allowing the bypass of propellant gases.

The projectile 10*z* shown in FIG. 17 is also provided with an optional intermediate structure 146 circumferentially about the body 14*z* between the seal 22*z* and the structure 142. The structure 146 may, like the structure 142, be in the form of a seal or a driving band. When both the structures 146 and 142 are in the form of a driving band, similar those described with reference to FIGS. 1-9, above, propellant gases can bypass the driving band 146 and flow toward the seal 22*z* to provide pressure equalisation between the inside and the outside of the cavity 20 within the barrel of the firearm. Also, when both structures 142 and 146 are in the form of driving bands the holes 144 are not needed to give pressure equalisation between inside and outside of the cavity 20.

If the structure 142 is in the form of a seal, then it may be beneficial for the holes 144 to exist to facilitate pressure equalisation. In that event, if the structure 146 is also present, it may be in the form of either a driving band or a seal. However, if it is in the form of a seal then additional holes 144*a* are formed, so that holes are now present on opposite sides of the structure 146 to give pressure equalisation for the length of the body 14*z* between the seal 22*z* and the structure 142, and the inside of the barrel.

The projectile 10*z* can be optionally provided with a rearward part 30*z* similar to the portion 30 described above and shown in FIGS. 1 and 2. This has the same characteristics and function as the portion 30. The portion 30*z* can either form a right angle with the trailing edge of the structure 142 as shown in the upper portion of FIG. 17; or taper down from the trailing edge of the structure 142 as shown in the bottom portion of FIG. 17.

Any one of the projectiles 10/10*i*/10*x*/10*y*/10*z* (hereinafter referred to in general as "projectile 10") may be used as a caseless projectile (i.e. a caseless round of ammunition) by closing the corresponding trailing end 18 with a base seal 134 having a primer 136 and flash hole 62 (shown in FIG. 14). The primer is arranged to initiate ignition of the propellant in the cavity 20 when struck by a firing pin or like mechanism.

Each of the projectiles 10*i*/10*x*/10*y*/10*z* 10 may alternately engaged with a case 54 or 54*a* in the same manner as described above with reference to FIGS. 10 and 11, to form a cased round of ammunition.

Whilst a number of specific embodiments of the projectile have been described, it should be appreciated that the projectile may be embodied in many other forms. For example, the leading end 16 can be formed with different configurations or structure to provide specific functionality or purpose. These configurations will structures include but are not limited to a hollow point, a soft point, a full metal jacket, spitzer, wad cutter, semi-wad cutter, or ogive including secant ogive and tangential ogive. In relation to a cased round 52 such as shown in FIG. 10 the cavity 20 at the trailing end 18 is sealed by abutment with the inside surface of the base 58. In this instance the maximum volume of propellant held by the round 52 is the volume of the cavity 20. However, in alternate embodiments the volume of propellant for a cased round can be increased by spacing of the trailing end 18 from the inside surface of the base 58 to create additional space for the propellant.

It is also possible to use the cavity 20 to hold materials/items in addition to the propellant. For example, a tracer compound can be provided within the cavity 20. This provides line of sight for the user but by having the tracer within the cavity 20 stray light is minimised or effectively shrouded by the cavity 20 to reduce the possibility of identifying the location of the user. Explosive material could also or alternately be provided in the cavity to form an explosive round of ammunition without departing from the benefits of the disclosed projectile 10. Embodiments of the projectile 10 may be made from a variety of materials and by various manufacturing techniques.

Further the variations between respectively described and illustrated embodiments are not mutually exclusive and can be incorporated in other embodiments. For example, the embodiment of the projectile shown in FIG. 4 may incorporate a driving band of any configuration and is not limited to only the driving band shown in the embodiment of FIG. 1. When the projectile incorporates two or more driving bands the driving bands do not need to have the same configuration as each other. It is also not an absolute requirement that the portion 50 of the cavity 20 of any embodiment necessarily have an interior surface of increasing inner the diameter in a direction toward the trailing end 18. Rather the cavity 20 can have the uniform inner diameter in the portion 50.

Embodiments of the projectile 10 may be used as live rounds of ammunition for military, policing and sporting or other recreational use.

Following tests on projectiles which provide for pressure equalization inside and outside of the cavity it is believed that embodiments of the disclosed projectile may provide at least one of the following benefits or advantages over conventional ammunition without the need for any modifications to the firing firearm:

The ability to attain a higher muzzle velocity than conventional long, high Ballistic Coefficient projectiles of the same length because:—

(i) there is no compromise on propellant-holding capacity, and (ii) it is lighter because of its hollow configuration;

The potential for further increases in muzzle velocities optimisation of propellant type (burn rate etc) to suit the changes in internal ballistics brought about by the projectile change;

Improved pressure-to-velocity relationship yielding higher velocities for any given chamber pressure;

Accuracy which matches or exceeds that of conventional projectiles;

Greater in-flight stability as the externally-biased weight distribution of the projectile increases its gyroscopic stability;

The improved gyroscopic stability allows the projectile to be used in rifle barrels with slower twist rates than is the case with conventional projectiles;

Flatter trajectory than conventional projectiles due to its higher muzzle velocity and its higher Ballistic Coefficient when compared to projectiles of similar weight or length;

The flatter trajectory, as well as equal or improved accuracy, allows for an increase in effective range;

Expected reduction in muzzle flash, muzzle blast and noise, compared to conventional ammunition—while maintaining or increasing muzzle velocity—in shorter rifles and carbines, including bullpup-style firearms;

Adaptable for a range of firearms including handguns and rifles;

Scalable to any caliber for light and medium arms ammunition;

With reference to the cases round shown in FIG. 11, the driving bands 28 and 28', each having a relatively small axial length, may be replace with one of the driving bands **28*b*1, 28*b*2, 28*c*, 28*d*** which have a longer axial length to aid in centralisation within the necked case.

With reference to the projectiles which incorporate the insert 102/**102*a*/102*x*, instead of the insert being fully inserted into the body 14 so that the shoulder 110 abuts the seat 108, insert may be only partially inserted so that prior to firing there is no direct contact between the seat 108 and the shoulder 110. For example, there could be a 5-10 mm gap between the seat 108 and the shoulder 110. On firing the insert would travel this 5-10 mm within and relative to the body 14 to abut the seat 108** and form a seal while the projectile remains within the barrel.

This allows for the insert to telescope forward upon firing by action of the pressure of gases generated by the propellant, therefore extending the overall length of the projectile 10 or providing a preferred profile for the projectile tip. This could be useful in tubular magazines where the projectiles are stacked end to end and a pointed tip could result in one cartridge contacting and detonating the primer of the one in front (due to recoil of the firearm). Alternatively, it could allow for long projectiles (in their extended form) to be used in magazines or revolver chambers where the overall cartridge length is limited and not suitable for long, high ballistic coefficient projectiles.

The disclosed embodiments have been described predominately in relation to non-explosive rounds of ammunition. Non-explosive ammunition may be in the form of ammunition for small arms, a light firearm, or canon in which the effect of the round arises solely from its kinetic energy rather than due to the detonation of an explosive material at or near a target or impact location. Nevertheless, the disclosed projectiles and concepts may be used with, or modified to form, an explosive round of ammunition. This may be manifested in larger caliber rounds for example by providing of explosive material in the body 14; or for embodiments with the insert, by provision of explosive material in the insert so that the round becomes an explosive tip round.

In the claims which follow, and in the preceding description, except where the context requires otherwise due to express language or necessary implication, the word "comprise" and variations such as "comprises" or "comprising" are used in an inclusive sense, i.e. to specify the presence of the stated features but not to preclude the presence or addition of further features in various embodiments of the projectile as disclosed herein.

The invention claimed is:

1. An unfired projectile configured to be fired from a barrel of a firearm, the projectile comprising:

an elongated tubular body having a leading end and a trailing end and a passage extending through the body and opening onto the leading end;

an insert disposed in the passage;

a cavity in the body between the insert and the trailing end;

a volume of propellant held in the cavity for propelling the projectile through a barrel of a firearm;

a seal arrangement formed on the body and located between and in-board of the leading end and the trailing end, the seal arrangement extending circumferentially about body to form a substantial seal against an inner circumferential surface of the barrel; and a driving band supported on the body between the seal arrangement and the trailing end and arranged about the body in manner to maintain substantial coaxial alignment of the body of the projectile and the barrel of the firearm while the projectile travels along the barrel, the driving band having one or more flow paths that enable fluid communication between opposite axial ends of the driving band.

2. The projectile according to claim 1 wherein the passage has an inner diameter smaller than an inner diameter of the cavity.

3. The projectile according to claim 2 wherein the body has a rearward portion that extends from the driving band to the trailing end, the rearward portion configured to enable fluid communication between the seal arrangement and the trailing end.

4. The projectile according to claim 1 comprising a seat inside the body and wherein the insert is provided with a shoulder configured to come into face to face abutment with the seat.

5. The projectile according to claim 4 wherein the seat is formed with a tapered surface transitioning the inner diameter of the passage to the inner diameter of the cavity.

6. An ammunition round comprising:

a projectile according to claim 1;

a base seal closing the trailing end to confine the propellant in the cavity; and, a primer supported in the base seal.

7. The ammunition round according to claim 6 wherein the quantity of propellant is such that substantially the entire cavity is filled with the propellant.

8. An unfired projectile configured to be fired from a barrel of a firearm, the projectile comprising:

an elongated tubular body having a leading end and a trailing end and a passage extending through the body and opening onto the leading end and the trailing end;

an insert disposed in the passage; and a cavity in the body between the insert and the trailing end; and a volume of a propellant held in the cavity for propelling the projectile through a barrel of a firearm, the passage having an inner diameter smaller than an inner diameter of the cavity to form a seat internal of the body and in board of the leading end, and wherein the insert is provided with a shoulder configured so that when the insert is fully inserted in the passage from the trailing end the insert abuts the seat to close the passage and forms a seal prevent the escape of gas generated by deflagration of the propellant from the leading end.

9. The projectile according to claim 8, wherein the insert is arranged to extend beyond the leading end of the body and form a tip of the projectile.

10. The projectile according to claim 8, wherein the insert and the body are configured so that together the projectile is formed with: (a) a ballistic tip; or (b) a hollow tip.

11. The projectile according to claim 8 comprising a tip separate from the insert, wherein the tip is configured to engage the passage from the leading end of the body.

12. The projectile according to claim 11 wherein the passage, tip and insert are relatively dimensioned so that when the tip is engaged with the passage and the insert is seated in the passage, a space or cavity is formed between the tip and the insert.

13. The projectile according to claim 11 wherein the tip and the body are configured so that the projectile is formed with either a ballistic tip or a hollow tip.

14. The projectile according to claim 11 wherein the tip and the insert are made from different materials from each other.

15. The projectile according to claim 8 comprising a seal arrangement formed on the body and located between and in-board of the leading end and the trailing end, the seal arrangement protruding radially from an outer circumferential surface of the body to form a substantial seal against an inner circumferential surface of the barrel.

16. An ammunition round comprising:

a projectile according to claim 1;

a case sealed at one end by a base, the case fitted over a portion of the projectile body with the base facing the trailing end of the projectile and closing the cavity; and wherein the leading end of the projectile protrudes from the case.

17. The ammunition round according to claim 16 wherein the case and the projectile body are relatively dimensioned so that the case at least partially overlies the seal arrangement.

18. The ammunition round according to claim 16 wherein the projectile and the case are relatively dimensioned such that a space is formed between the trailing end of the projectile body and the base of the case and wherein the propellant is retained between an inner surface of the cavity and the base of the case.

19. The ammunition round according to claim 18 wherein the propellant is provided in a (a) volume greater than that of the space so that at least a proportion of the propellant is held in the cavity; or (b) a volume to substantially fill the space and the cavity.

20. An ammunition round comprising:

a projectile according to claim 8;

a case sealed at one end by a base, the case fitted over a portion of the projectile body with the base facing the trailing end of the projectile and closing the cavity; and wherein the leading end of the projectile protrudes from the case.

21. An unfired projectile for an ammunition round configured to be fired from a barrel of a firearm, the projectile comprising:

an elongated body having a leading end, an axially aligned trailing end, and an internal cavity extending between the leading end and the trailing end;

a volume of propellant held in the cavity for propelling the projectile;

a seal arrangement formed on the body and located between and in-board of the leading end and the trailing end, the seal arrangement protruding radially from an outer circumferential surface of the body to form a substantial seal against an inner circumferential surface of the barrel;

a driving band supported on the body between the seal arrangement and the trailing end, and wherein the body has a rearward portion that extends from the driving band to the trailing end, the driving band extending circumferentially about the body and having an outer circumferential surface which has a maximum outer diameter arranged to contact at least a portion of the inner circumferential surface of the barrel; and one or more flow paths that enable fluid communication across the driving band between the single seal and the rearward portion of the body.

22. The projectile according to claim 21 wherein the driving band comprises one or more ring like structure extending about a longitudinal axis of the body and the flow paths comprise one or more gaps or recesses an outer circumferential surface of the ring like structure.

23. The projectile according to claim 22 wherein the driving band has an outer radius which varies about the longitudinal axis between a maximum outer radius and a minimum outer radius which is less than the maximum outer radius and equal to or greater than an outer radius of the body immediately adjacent the driving band.

24. The projectile according to claim 21 wherein the driving band comprises: one or more ring like structures extending about a longitudinal axis of the body and the flow paths comprise holes formed axially in the driving band radially inside of an outer circumference surface of the driving band; or at least one of a: (a) knurled outer surface; (b) plurality of ribs that extend along the body; and (c) a plurality of protrusions on the body.

25. The projectile according to claim 21 wherein a bounded portion of the body between the seal arrangement and the driving band has a continuous outer circumferential surface and forms a barrier for fluid communication in a radial direction through the body for an entire length of the bounded portion.

26. The projectile according to claim 21 wherein at least a part of the rearward portion of the projectile body is formed with a reducing outer diameter.

27. The projectile according to claim 21 wherein a portion of the cavity leading to the trailing end has a progressively increased inner diameter.

28. The projectile according to claim 21 wherein the body and (a) the sealing arrangement are formed as a one piece structure and the sealing arrangement is fixed from axial motion relative to the body; or (b) the driving band are formed as a one piece structure and the sealing arrangement is fixed from axial motion relative to the body; or (c) the sealing arrangement and the driving band are formed as a single integral unit from the same material and the sealing arrangement is fixed from axial motion relative to the body.

29. An ammunition round comprising:

a projectile according to claim 21;

a case sealed at one end by a base, the case fitted over a portion of the projectile body with the base facing the trailing end of the projectile and closing the cavity; and wherein the leading end of the projectile protrudes from the case.

* * * * *